United States Patent [19]

Goldsmith

[11] 4,247,104

[45] Jan. 27, 1981

[54] TENNIS RACQUET

[75] Inventor: Eli D. Goldsmith, Roslyn Heights, N.Y.

[73] Assignee: Crown Recreation, Inc., Hollis, N.Y.

[21] Appl. No.: 7,879

[22] Filed: Jan. 31, 1979

[51] Int. Cl.[3] ..... A63B 49/02

[52] U.S. Cl. ..... 273/73 C

[58] Field of Search ..... 273/67 R, 73 R, 73 C, 273/73 D, 73 E, 73 F, 73 H, 76; D21/210–213

[56] References Cited

U.S. PATENT DOCUMENTS

| | | | |
|---|---|---|---|
| D. 245,034 | 7/1977 | Segal et al. | D21/212 |
| 3,834,699 | 9/1974 | Pass | 273/73C X |

FOREIGN PATENT DOCUMENTS

| | | | |
|---|---|---|---|
| 1495578 | 8/1967 | France | 273/73 D |
| 14147 | of 1885 | United Kingdom | 273/73 D |
| 755257 | 8/1956 | United Kingdom | 273/73 C |

*Primary Examiner*—Richard J. Apley
*Attorney, Agent, or Firm*—Richard M. Rabkin

[57] ABSTRACT

A racket, for use in playing tennis and similar games, includes a frame which defines a head and a handle, with the head having a generally polygonal configuration defined by a first pair of sides that extend from the handle away from each other to the widest portion of the head and a second pair of sides, connected to the first pair at the widest portion of the handle, extending back towards each other. The second pair of sides are longer in length than the first pair of sides and are connected by a fifth side which extends parallel to the widest portion of the head. Strings are strung between the sides of the head to define an impact surface which provides an enlarged "sweet" spot on the racket near the widest portion of the head as compared to conventionally shaped oval tennis rackets.

9 Claims, 3 Drawing Figures

TENNIS RACQUET

The present invention relates to tennis rackets and in particular to a tennis racket which has improved play characteristics.

While the game of tennis has been played for over 100 years, the tennis rackets which have been used have not materially changed in configuration. While improvements have been made over the years in materials for tennis rackets, the general shape of the racket remains the same. This shape, by custom and convention, but not by regulation of the various lawn tennis associations, is generally approximately 27" long and includes an elliptical or oval head secured to a handle. The head is, of course, strung with nylon, catgut or some other material in a crossed pattern to provide an impact surface.

The standard elliptical heads for tennis rackets generally define a strung area of approximately seventy square inches and have a long dimension of approximately 11". The short or minor diameter of the elliptical head generally is 9" wide. This minor diameter of the ellipse is located at the central point of the length of the head, i.e. approximately 5½" from the end of the head and 5½" from the point of connection of the head to the handle. Thus the head has the general configuration of a true ellipse.

For conventional tennis rackets of all types there is a particular impact area on the head, which is not the geometric center of the elliptical area, that is referred to as the "sweet" spot. This sweet spot is also referred to more correctly as the "center of percussion".

It has been found that because of the configuration of the conventional elliptical tennis racket head, a large portion of the strung area is not effective in hitting, and the sweet spot on the racket is relatively small. Accordingly, recent attempts have been made to increase the size of the sweet spot, as for example in the "PRINCE" tennis racket which is available from Prince Manufacturing Inc. That tennis racket uses a materially enlarged head to increase the size of the sweet spot and to locate the sweet spot closer to the handle. However, some players have found that this enlarged racket is somewhat cumbersome to use, and it has been suggested that perhaps this type of racket would be "outlawed" by regulations established by the various lawn tennis associations limiting the surface area of racket heads.

Other attempts have been made to improve the play characteristics of tennis rackets by changing their construction or shape, as shown for example in U.S. Pat. Nos. 3,917,267; 3,834,699; 3,801,099; 2,004,609 but these, it is believed, do not achieve an enlarged "sweet" spot, reduced bending on impact and the other advantages of the racket of the present invention.

It is an object of the present invention to increase the size of the "sweet" spot in a tennis racket at a location on the racket head which is close to the handle.

Another object of the present invention is to provide a racket head whose configuration permits a larger portion of the strung area of the head to be positioned near the ground for ground strokes.

A further object of the present invention is to provide a tennis racket which has improved play characteristics and yet is relatively inexpensive to manufacture.

In accordance with an aspect of the present invention a tennis racket is provided which includes a frame that defines a head and a handle. The head has a generally polygonal configuration that includes a plurality of sides which define the widest portion of the head at a position that is closer to the handle than one half of the length of the head. The sides include a pair of first straight sides extending from the handle and diverging from each other to the widest portion of the head. A second pair of sides extend from the first sides, at the widest portion of the head, and converge towards each other. A fifth side, parallel to the widest portion of the head, connects the second sides.

The second sides of the racket head are longer than the first sides, and the latter are connected to each other by a plastic yoke member secured to the first sides adjacent the handle. The racket head is strung between the sides and yoke to define an impact area whose sweet spot is located adjacent the widest portion of the head. The sweet spot which results with this racket configuration is larger than the sweet spot in conventional elliptical racket constructions because the wider portion of the head impact area is closer to the handle and thus closer to the racket's center of percussion. In this way, not only is an enlarged sweet spot provided for the player, but less bending stress is applied to the neck and handle of the racket, since the point of impact of the ball against the racket will generally be closer to the handle, producing less moment forces thereon. Therefore, the racket will have a materially longer life, and/or can be made of a lighter weight material.

In addition, by this configuration of the tennis racket, particularly due to the location of the widest portion of the head with respect to the length of the head, in a ground stroke where the racket must be brought close to the ground a flat edge or side is presented parallel to the ground in the normal position for most players so that a materially larger portion of the strung area of the racket head will be close to the ground in position for impact with a low bouncing ball as compared to the area available with a conventional oval or elliptical tennis racket.

The above, and other objects, features and advantages of this invention will be apparent in the following detailed description of an illustrative embodiment thereof, which is to be read in connection with the accompanying drawings wherein.

Figures 1, 2, 3:
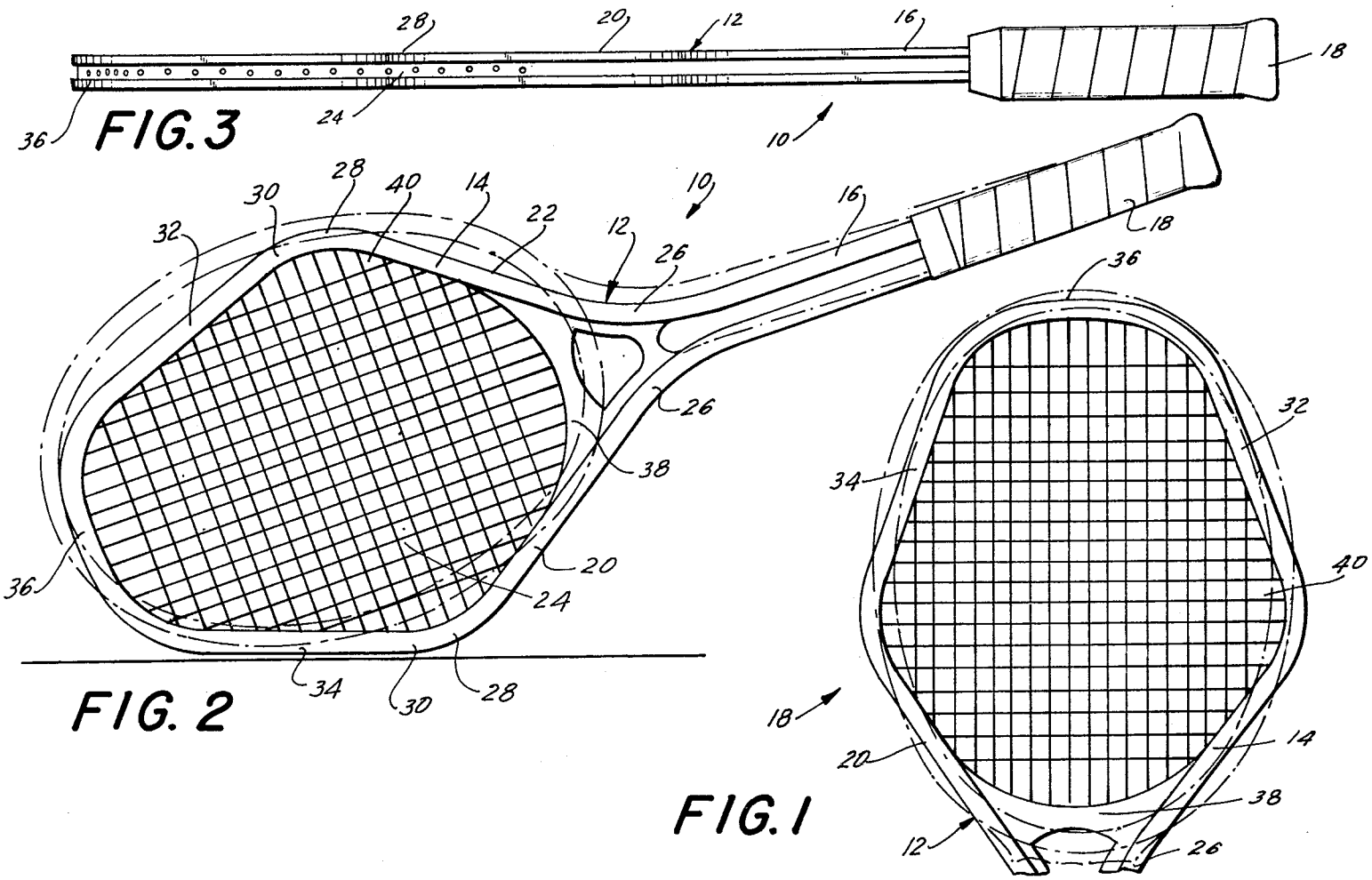
FIG. 1 is a plan view of a tennis racket head constructed in accordance with the present invention and shown in solid lines; a conventional elliptical tennis racket head is shown in dotted lines superimposed over the racket head of the present invention.
FIG. 2 is an elevational view of the tennis racket of the present invention shown in position during a ground stroke, and having a conventional tennis racket shown in dotted lines superimposed thereon for comparison purposes.
FIG. 3 is a side view of the tennis racket shown in FIGS. 1 and 2.

Referring now to the drawings in detail, and initially to FIG. 1 thereof, a tennis racket head 10 is illustrated constructed in accordance with the present invention. The tennis racket includes a frame 12 which defines a head 14 and a handle 16. The frame is formed of any suitable material, although preferably I found that one piece bent tubular aluminum or steel is satisfactory.

Handle 16 terminates in a conventional grip structure 18, such as wrapped leather or the like.

The polygonal head 14 of the tennis racket includes a pair of first sides 20, 22 which extend from handle 16 away from each other to the widest portion 24 of the racket head. The first ends 26 of the sides 20, 22 are joined integrally with handle 16 and their second ends 28, at the widest portion 24 of the head, are joined to the first ends 30 of long sides 32, 34 respectively. These long sides converge towards each other and are connected by an integral fifth side 36.

The first sides 20, 22 of head 14 are joined to each other by a yoke 38 formed of molded plastic or the like secured to the first sides and handle 16 at the juncture with the ends 26 of these first sides. The sides of the head and the yoke define an impact area which is strung in any convenient manner with nylon strings, catgut or the like. The impact area defined by strings 40 has a generally polygonal configuration, with its widest portion 24 located at the juncture between the first and second sides of the racket head. This juncture is located, due to the relative lengths of the head sides, to be closer to the handle 16 than one half of the length of the head itself. However, the sides of the head are dimensioned such that the area of this impact surface is approximately seventy square inches, or essentially the same as that of a conventional elliptical tennis racket head. By locating the widest portion of the rackt closer to the handle than conventionally, as in a conventional elliptical head racket, the impact area of the racket at the center of percussion of the racket, i.e. the area of the sweet spot, is increased in size, and also located somewhat closer to the handle than in conventional rackets. Thus the racket head will have improved play characteristics because of the enlarged sweet spot, and less bending stress will be applied to the handle because the moment forces produced by the impact of a ball on the sweet spot will be less, as compared to those which occur in conventional rackets.

In addition, because the sides of the racket head are straight and arranged in the approximate angular relation defined hereinafter, when a player makes a ground stroke positioning the racket close to the ground in the normal attitude for an average player, as shown in FIG. 2, more of the strung area of the racket is presented close to the ground as compared to a conventional tennis racket. As seen in FIG. 2, because of the oval shape of the conventional racket, shown in dotted lines, there is only one portion of the racket frame which can contact the ground, and the rest of the frame diverges away from the ground. With applicant's invention on the other hand a major portion of the length of the racket along the flat side 34 is adjacent the ground, providing a broader area which can be used to impact a ball close to the ground. This is extremely important as ground strokes of this type are very difficult to hit successfully and the more surface area of the racket presented to the ball the better are the chances that a proper stroke will be made.

While it has been found that the tennis racket of the invention can be formed in a variety of different dimensions, it is preferable to dimension the head such that the impact surface area is approximately equal to that of a conventional tennis racket, i.e. seventy square inches as discussed above. In addition, it has been found that the advantages of the present invention can be achieved by dimensioning the head with maximum dimensions which are similar to those of a conventional racket so that the feel of the racket remains essentially the same and the dimensions conform generally with conventional dimensions, in the event that restrictions on head size are established by the various lawn tennis associations. Thus, it is presently preferred that the width of the head at the widest point be essentially the same as that of a conventional tennis racket, i.e. approximately 9 inches and that its length be essentially the same, i.e. approximately 11 inches. In addition, it has been found that a preferred angle between the short and long sides is approximately 120 °, and the angle between the fifth side 36 and the long sides is approximately 110°.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

What is claimed is:

1. A racket comprising a frame defining a head and a handle, said head having a generally polygonal configuration including a first pair of sides extending from first ends at said handle away from each other to second ends, a second pair of sides respectively associated with said first sides and connected at first ends to the second ends of their associated first sides and extending towards each other to second ends, said second pair of sides being larger in length than said first sides; and a fifth side connecting the second ends of said second pair of sides to close said head; and string means between said sides for defining an impact surface; the point of juncture of said first and second sides being spaced from each other a predetermined distance to define the widest point of said head and being located closer to said handle than one half the length of the head thereby to define an enlarged "sweet spot" on the racket; said first shorter sides of the head being generally parallel to the second longer sides of the head to which they are not connected.

2. A racket as defined in claim 1 wherein each connected first and second side define an angle therebetween of more than 90°.

3. A racket as defined in claim 2 wherein said angle is approximately 120°.

4. A racket as defined in claim 3 wherein said fifth side and said second sides define angles therebetween of more than 90°.

5. A racket as defined in claim 4 wherein said angles between said fifth and second sides are approximately 110°.

6. A racket as defined in claim 5 wherein said head defines a string area of approximately 70 square inches, has a long dimension of approximately 11 inches and a short dimension between said points of juncture of approximately 9 inches.

7. A racket comprising a frame defining a head and handle, said head having a generally polygonal configuration including a plurality of sides defining the widest portion of the head at a position which is closer to the handle than one half of the length of the head; said sides including a pair of first straight sides extending from said handle and diverging from each other to the widest portion of the head and a pair of second sides extending from said first sides at the widest portion of the head towards each other and a fifth straight side parallel to the widest portion of the head connecting said second sides; said second sides being longer than said first sides; a yoke member secured to said first sides adjacent said handle; and string means strung between said head sides and said yoke for defining an impact area including a sweet spot located adjacent said wider portion of the head; said first sides of the head being generally parallel to the second sides of the head to which they are not connected.

8. A racket as defined in claim 7 wherein said first and second sides define therebetween, at said widest portion of the head an angle of approximately 120°.

9. A racket as defined in claim 8 wherein said head defines a string area of approximately 70 square inches, has a long dimension of approximately 11 inches and a short dimension between said points of juncture of approximately 9 inches.

* * * * *